US006193588B1

(12) United States Patent
Carlson et al.

(10) Patent No.: US 6,193,588 B1
(45) Date of Patent: Feb. 27, 2001

(54) METHOD AND APPARATUS FOR PLANARIZING AND CLEANING MICROELECTRONIC SUBSTRATES

(75) Inventors: David W. Carlson, Windham, ME (US); Scott A. Southwick, Boise; Scott E. Moore, Meridian, both of ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/146,055

(22) Filed: Sep. 2, 1998

(51) Int. Cl.[7] ..... B24B 29/02

(52) U.S. Cl. ..... 451/66; 451/307; 451/168; 451/173

(58) Field of Search ..... 451/41, 57, 66, 451/285–289, 307, 173, 37, 168, 539, 461

(56) References Cited

U.S. PATENT DOCUMENTS

| | | | | |
|---|---|---|---|---|
| 3,841,031 | * | 10/1974 | Walsh | 451/461 |
| 4,481,741 | * | 11/1984 | Bouladon et al. | 451/285 |
| 5,573,444 | * | 11/1996 | Ryoke et al. | 451/28 |
| 5,738,576 | * | 4/1998 | Ohno et al. | 451/539 |
| 5,967,881 | * | 10/1999 | Tucker | 451/41 |
| 6,062,958 | * | 5/2000 | Wright et al. | 451/41 |

* cited by examiner

*Primary Examiner*—David A. Scherbel
*Assistant Examiner*—G. Nguyen
(74) *Attorney, Agent, or Firm*—Dorsey & Whitney LLP

(57) ABSTRACT

A method and apparatus for mechanically and/or chemical-mechanically planarizing and cleaning microelectronic substrates. In one embodiment, a processing medium for planarizing and finishing a microelectronic substrate has a planarizing section with a first body composed of a first material and a finishing section with a second body composed of a second material. The first body may have a relatively firm planarizing surface to engage the substrate, and the first body supports abrasive particles at the planarizing surface to remove material from the substrate during a planarizing cycle. The second body may have a relatively soft buffing or finishing surface clean the abrasive particles and other matter from the substrate during a finishing cycle. The planarizing and finishing sections may be fixedly attached to a backing film, or they may be attached to one another along abutting edges with or without the backing film. In one particular embodiment, the processing media may be an elongated web configured to extend between a supply roller and a take-up roller of a web-format planarizing machine having a plurality of individually driven substrate holders. The planarizing and finishing sections of this embodiment may be long strips of material extending lengthwise along a longitudinal axis of the web. The planarizing machine and elongated web may contemporaneously planarize and finish two or more substrates.

27 Claims, 7 Drawing Sheets

METHOD AND APPARATUS FOR PLANARIZING AND CLEANING MICROELECTRONIC SUBSTRATES

TECHNICAL FIELD

The present invention relates to mechanical and chemical-mechanical planarization of microelectronic substrates. More particularly, the present invention relates to processing media having a planarizing surface to planarize a microelectronic substrate and a separate finishing surface to clean the microelectronic substrate after planarization.

BACKGROUND OF THE INVENTION

Mechanical and chemical-mechanical planarization processes remove material from the surfaces of semiconductor wafers, field emission displays and many other microelectronic substrates to form a flat surface at a desired elevation. FIG. 1 schematically illustrates a planarizing machine 10 with a platen or base 20, a carrier assembly 30, a planarizing medium 40, and a planarizing liquid 44 on the planarizing medium 40. The planarizing machine 10 may also have an under-pad 25 attached to an upper surface 22 of the platen 20 for supporting the planarizing medium 40. In many planarizing machines, a drive assembly 26 rotates (arrow A) and/or reciprocates (arrow B) the platen 20 to move the planarizing medium 40 during planarization.

The carrier assembly 30 controls and protects a substrate 12 during planarization. The carrier assembly 30 generally has a substrate holder 32 with a pad 34 that holds the substrate 12 via suction. A drive assembly 36 of the carrier assembly 30 typically rotates and/or translates the substrate holder 32 (arrows C and D, respectively). The substrate holder 32, however, may be a weighted, free-floating disk (not shown) that slides over the planarizing medium 40.

The planarizing medium 40 and the planarizing liquid 44 may separately, or in combination, define a polishing environment that mechanically and/or chemically-mechanically removes material from the surface of the substrate 12. The planarizing medium 40 may be a conventional polishing pad composed of a polymeric material (e.g., polyurethane) without abrasive particles, or it may be an abrasive polishing pad with abrasive particles fixedly bonded to a suspension material. In a typical application, the planarizing liquid 44 may be a chemical-mechanical planarization slurry with abrasive particles and chemicals for use with a conventional nonabrasive polishing pad. In other applications, the planarizing liquid 44 may be a chemical solution without abrasive particles for use with an abrasive polishing pad.

To planarize the substrate 12 with the planarizing machine 10, the carrier assembly 30 presses the substrate 12 against a planarizing surface 42 of the planarizing medium 40 in the presence of the planarizing liquid 44. The platen 20 and/or the substrate holder 32 then move relative to one another to translate the substrate 12 across the planarizing surface 42. As a result, the abrasive particles and/or the chemicals in the polishing environment remove material from the surface of the substrate 12.

Planarizing processes must consistently and accurately produce a uniformly planar surface on the substrate to enable precise fabrication of circuits and photo-patterns. As the density of integrated circuits increases, the uniformity and planarity of the substrate surface is becoming increasingly important because it is difficult to form sub-micron features or photo-patterns to within a tolerance of approximately 0.1 $\mu$m on non-uniform substrate surfaces. Thus, planarizing processes must create a highly uniform, planar surface on the substrate.

To obtain a highly uniform substrate surface, conventional planarizing processes generally involve two separate cycles: (1) a planarizing cycle in which material is abraded and/or etched from the substrate with a primary planarizing medium and a planarizing liquid as set forth above; and (2) a finishing cycle in which very small defects are smoothed-out and waste particles are cleaned from the substrate surface with a secondary finishing medium and an appropriate cleaning fluid (e.g., deionized water). The primary planarizing medium used during the initial planarizing cycle may be a firm polyurethane polishing pad with holes or grooves designed to transport a portion of the planarizing liquid below the substrate surface. The polishing pad may alternatively be an abrasive polishing pad with abrasive particles fixedly bonded to a suspension material. The secondary finishing medium used during the finishing cycle may be a soft, compressible material with a napped fiber surface. For example, the finishing medium may be a compressible, nonabrasive polyurethane pad with a napped surface.

The two separate cycles of conventional planarizing processes are generally performed at two separate work-stations of a single planarizing machine or on two separate machines. For example, a first work-station of a typical planarizing machine has a first platen supporting the primary planarizing medium, and a second work-station has a second platen supporting the secondary finishing medium. In the operation of the planarizing machine 10 shown in FIG. 1, the substrate holder 32 initially picks up the substrate 12 from an external stack of substrates (not shown), and then the carrier assembly 30 positions the substrate 12 on the primary planarizing medium 40 of the first work-station to commence the planarizing cycle. After the planarizing cycle has finished, the carrier assembly 30 moves the substrate 12 to the finishing medium (not shown) at the second work-station (not shown). For example, the finishing medium is typically mounted to a second platen (not shown) that moves the finishing medium as a nozzle (not shown) sprays deionized water near the substrate to clean the substrate surface. After the finishing cycle is over, the carrier assembly 30 places the substrate 12 in a measuring machine (not shown) to measure the thickness of particular layers on the substrate. This two-cycle process is then repeated with a new wafer.

In the competitive semiconductor and microelectronic device manufacturing industries, it is desirable to maximize the throughput of finished substrates. One drawback of conventional two-cycle planarizing processes, however, is that the time between the planarizing and finishing cycles reduces the throughput. For example, because conventional planarizing machines have separate planarizing and finishing media at separate work-stations, it typically takes 5–10 seconds to transfer the substrate from the planarizing medium to the finishing medium. Although a 5–10 second delay may not seem important, it results in a significant amount of down-time in large scale operations that manufacture devices on several thousand substrates each year and planarize each substrate several times. Accordingly, it would be desirable to reduce the down-time between the planarizing and finishing cycles.

Another drawback of conventional two-cycle planarization processes is that the finishing cycle increases the time of the overall process for each substrate. In conventional processes, the planarizing cycle typically runs for approximately 60–300 seconds, and the conditioning cycle typically runs for approximately 30–60 seconds. Because the substrate carrier sequentially positions the substrate on the planarizing media and then the finishing media, the planarizing media remains idle during the finishing cycle. The entire finishing cycle, therefore, is down-time for the planarizing medium. Thus, it would be desirable to develop a more efficient process and apparatus for performing the planarizing and finishing cycles.

Still another drawback of conventional two-cycle planarization processes is that the planarizing machines must have two separate work-stations. For example, the conventional planarizing machine described above has two separate platens for individually controlling the planarizing and finishing media. As such, conventional two-station planarizing machines may have duplicative components that do not enhance the throughput of finished substrates.

SUMMARY OF THE INVENTION

The present invention is a method and apparatus for mechanically and/or chemical-mechanically planarizing and cleaning microelectronic substrates. In one embodiment, a processing medium for planarizing and finishing a microelectronic substrate has a planarizing section with a first body composed of a first material and a finishing section with a second body composed of a second material. The first body may have a relatively firm planarizing surface to engage the substrate, and the first body supports abrasive particles at the planarizing surface to remove material from the substrate during a planarizing cycle. The second body may have a relatively soft buffing or finishing surface to clean the abrasive particles and other matter from the substrate during a finishing cycle. The planarizing and finishing sections may be fixedly attached to a backing film, or they may be attached to one another along abutting edges with or without the backing film.

In one particular embodiment, the processing media may be an elongated web configured to extend between a supply roller and a take-up roller of a web-format planarizing machine. The planarizing and finishing sections of this embodiment may be long strips of material extending lengthwise along a longitudinal axis of the web. In another embodiment, the planarizing and finishing sections may be coupled to a backing film in alternating transverse strips so that the abutting edges extend along a widthwise dimension of the web. As such, there may be a plurality of different sections or zones upon which the microelectronic substrates may be planarized and cleaned.

DETAILED DESCRIPTION OF THE INVENTION

The present invention is an apparatus and method for mechanical and/or chemical-mechanical planarization of substrates used in the manufacturing of microelectronic devices. Many specific details of certain embodiments of the invention are set forth in the following description and in FIGS. 2–8 to provide a thorough understanding of such embodiments. One skilled in the art, however, will understand that the present invention may have additional embodiments or that the invention may be practiced without several of the details described in the following description.

Figure 1:
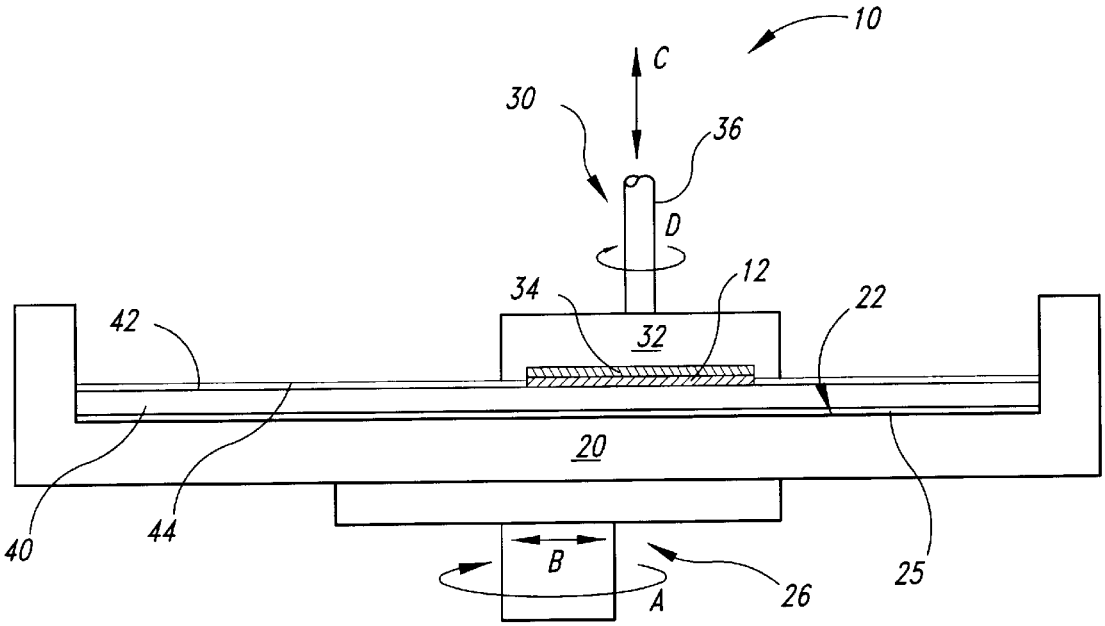
Fig. 1 (Prior Art)
FIG. 1 is a schematic view of a planarizing machine in accordance with the prior art.
Figure 2:
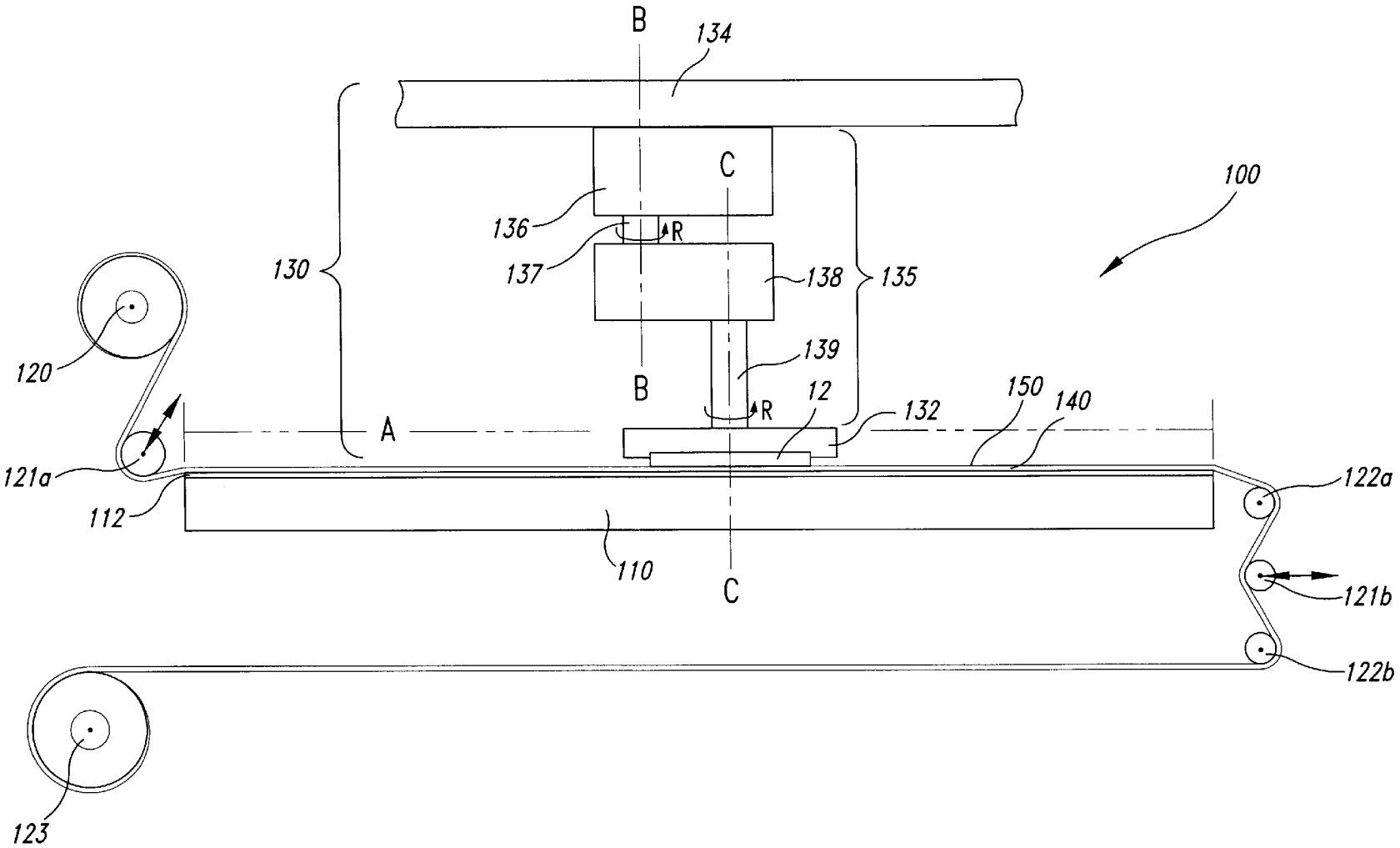
FIG. 2 is a schematic side elevational view of a planarizing machine with a processing medium in accordance with an embodiment of the invention.

FIG. 2 is a schematic side elevational view of a planarizing machine 100 and a processing medium 140 in accordance with one embodiment of the invention for planarizing and cleaning a substrate 12. The features and advantages of the processing medium 140 are best understood in the context of the structure and operation of the planarizing machine 100. Thus, the general features of the planarizing machine 100 will be described initially.

The planarizing machine 100 may have a support table 110 carrying a base 112 at a workstation where an operative portion "A" of the processing medium 140 is positioned. The base 112 is generally a rigid panel or plate attached to the table 110 to provide a flat, solid surface to which a particular section of the processing medium 140 may be secured during planarization. The planarizing machine 100 also has a plurality of rollers to guide, position and hold the processing medium 140 over the base 112. In one embodiment, the rollers include a supply roller 120, first and second idler rollers 121*a* and 121*b*, first and second guide rollers 122*a* and 122*b*, and a take-up roller 123. The supply roller 120 carries an unused or pre-operative portion of the processing medium 140, and the take-up roller 123 carries a used or post-operative portion of the processing medium 140. A motor (not shown) drives at least one of the supply roller 120 and the take-up roller 123 to sequentially advance the processing medium 140 across the base 112. As such, unused sections of the processing medium may be quickly substituted for worn sections to provide a consistent surface for planarizing and/or cleaning the substrate 12. The first idler roller 121*a* and the first guide roller 122*a* stretch the processing medium 140 over the base 112 to hold the processing medium 140 stationary during operation.

The planarizing machine 100 also has a carrier assembly 130 to translate the substrate 12 across the processing medium 140. In one embodiment, the carrier assembly 130 has a substrate holder 132 to pick up, hold and release the substrate 12 at appropriate stages of the planarizing and finishing cycles. The carrier assembly 130 may also have a support gantry 134 carrying a drive assembly 135 that translates along the gantry 134. The drive assembly 135 has an actuator 136, a drive shaft 137 coupled to the actuator 136, and an arm 138 projecting from the drive shaft 137. The arm 138 carries the substrate holder 132 via another shaft 139. In another embodiment, the drive assembly 135 may also have another actuator (not shown) to rotate the shaft 139 and the substrate holder 132 about an axis C—C as the actuator 136 orbits the substrate holder 132 about the axis B—B. One suitable planarizing machine without the processing medium 140 is manufactured by EDC Corporation. In light of the embodiments of the planarizing machine 100 described above, a specific embodiment of the processing medium 140 will now be described in more detail.

Figure 3:
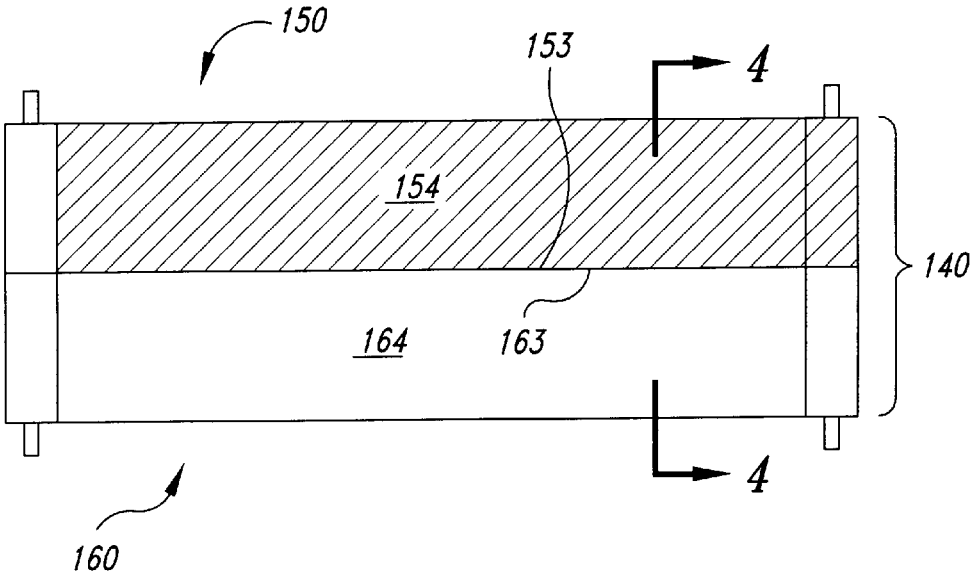
FIG. 3 is a partial schematic top view of a planarizing machine with a processing medium in accordance with an embodiment of the invention.
Figure 4:
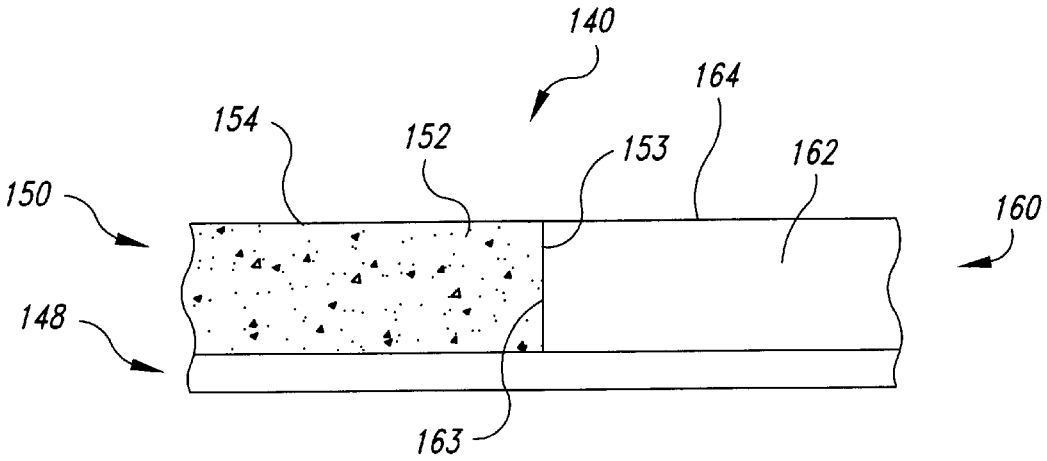
FIG. 4 is a schematic cross-sectional view of the processing medium of FIG. 3 taken along line 4—4.

FIG. 3 is a partial schematic top view of the processing medium 140 on the planarizing machine 100 (shown without the carrier assembly or the gantry), and FIG. 4 is a schematic cross-sectional view of the processing medium 140 shown in FIG. 3 taken along line 4—4. In this embodiment, the processing medium 140 is a web with a backing film 148 (FIG. 4), a planarizing section or medium 150 coupled to one portion of the backing film 148, and a finishing section or medium 160 coupled to another portion of the backing film 148. The planarizing and finishing sections 150, 160 may also be adhered to one another along abutting lengthwise edges 153, 163. The processing medium 140 is particularly well suited for operating on the web-format planarizing machine 100, but it may also be used on a machine with a rotating platen by making the planarizing and finishing section 150 and 160 circular (not shown). For example, one of the section 150, 160 may be have a circular shape centered at the rotational axis of the platen, and the other of the sections 150, 160 may be a concentric band surrounding the center section (not shown).

The backing film 148 may be a thin sheet that has a high tensile strength and is flexible, substantially incompressible, and impervious to planarizing chemicals. In some particular embodiments, the backing film 148 may be composed of copolymers or other suitable materials. The backing film 148 accordingly provides structural integrity to the web so that the planarizing and finishing sections may be composed of materials that are selected for their performance characteristics instead of their ability to maintain the integrity of the web. Two specific suitable materials for the backing film 148 are polyesters (e.g., Mylar® manufactured by E.I. du Pont de Nemours Co.) and polycarbonates (e.g., Lexan® manufactured by General Electric Co.).

As best shown in FIG. 4, the planarizing section 150 may have a first body 152 composed of a first material and a planarizing surface 154 defining a planarizing zone. The first body 152 may be a relatively firm, porous continuous phase material. The first body 152, for example, may be a porous polyurethane or another suitable polymeric material in which a plurality of stiffening beads are distributed. One suitable material for the first body 152 is a Rodel IC-1000 polishing pad manufactured by Rodel Corporation of Newark, Del. The IC-1000 pad is a firm porous polyurethane in which a plurality of polyethylene stiffening beads are distributed. The first body 152 of the planarizing section 150 may also have a plurality of abrasive particles fixedly bonded to the polymeric material. For example, as set forth in U.S. Pat. No. 5,624,303, which is owned by the assignee of the present application and is herein incorporated by reference, a plurality of abrasive particles composed of silicon dioxide may be fixedly bonded to a polyurethane suspension material with trichlorosilane bonding groups.

The first body 152 is preferably firm to provide a relatively hard, flat planarizing surface 154 that imparts more pressure to high points on the substrate surface than low points. The first body 152 is also preferably firm to support abrasive particles at the planarizing surface 154 where they can engage the substrate surface. For example, when the abrasive particles are either fixedly bonded to the first body 152 or deposited onto the first body 152 in an abrasive slurry, the body supports the abrasive particles to abrade material from the substrate. As such, the planarizing section 150 abrades high points on the substrate surface faster than low points to form a flat, uniform surface across the substrate 12.

As also best shown in FIG. 4, the finishing section 160 may have a second body 162 composed of a second material and a finishing surface 164 defining a cleaning zone. The second body 162 may be a relatively soft, compressible material with napped fibers at the finishing surface 164. The second body 162, for example, may be composed of felt or a compressible polyurethane with a napped finishing surface 164. One suitable material for the finishing section is the Rodel Polytex® finishing pad also manufactured by the Rodel Corporation. The finishing surface 164 may thus clean and/or buff the microelectronic substrate surface in the presence of deionized water or other cleaning solutions during a finishing cycle.

Compared to the planarizing section 150, the finishing section 160 is much softer and allows abrasive particles remaining on the substrate surface to be embedded between the napped fibers on the finishing surface 164. In further contrast to the planarizing section 150, the finishing section 160 is also highly compressible to conform to the topography of the substrate surface so that the napped fibers on the finishing surface 164 sweep chemicals and abrasive particles from low points on the substrate 12. Thus, the finishing section 160 does not aggressively remove material from the substrate 12.

In operation, the wafer 12 (FIG. 2) is initially planarized on the planarizing surface 154 of the first body 152. A planarizing liquid (e.g., a nonabrasive chemical solution or an abrasive slurry) is generally deposited onto the first body 152 during the planarization cycle to provide chemical removal of material from the substrate 12. In applications in which abrasive particles are fixedly bonded to the first body 152, however, the substrate may be planarized without a planarizing liquid. After the planarizing cycle, the processing medium 140 may be flushed with deionized water or another cleaning fluid as the carrier assembly 30 slides the substrate 12 across the processing medium 140 to the second body 162. The substrate 12 may then be buffed and/or cleaned on the finishing surface 164 during a finishing cycle to remove the planarizing liquid, abrasive particles and other small defects from substrate 12. Accordingly, the processing medium 140 shown in FIGS. 3 and 4 allows the substrate 12 to be moved from the planarizing section 150 to the finishing section 160 without disengaging the substrate 12 from the processing medium 140 or moving it to another workstation. This particular embodiment of the processing medium 140, therefore, is expected to increasing the throughput of finished substrates by reducing the down-time between cycles. The processing medium 140 may also reduce the cost of planarization machines by eliminating redundant components at multiple work-stations.

Figure 5:
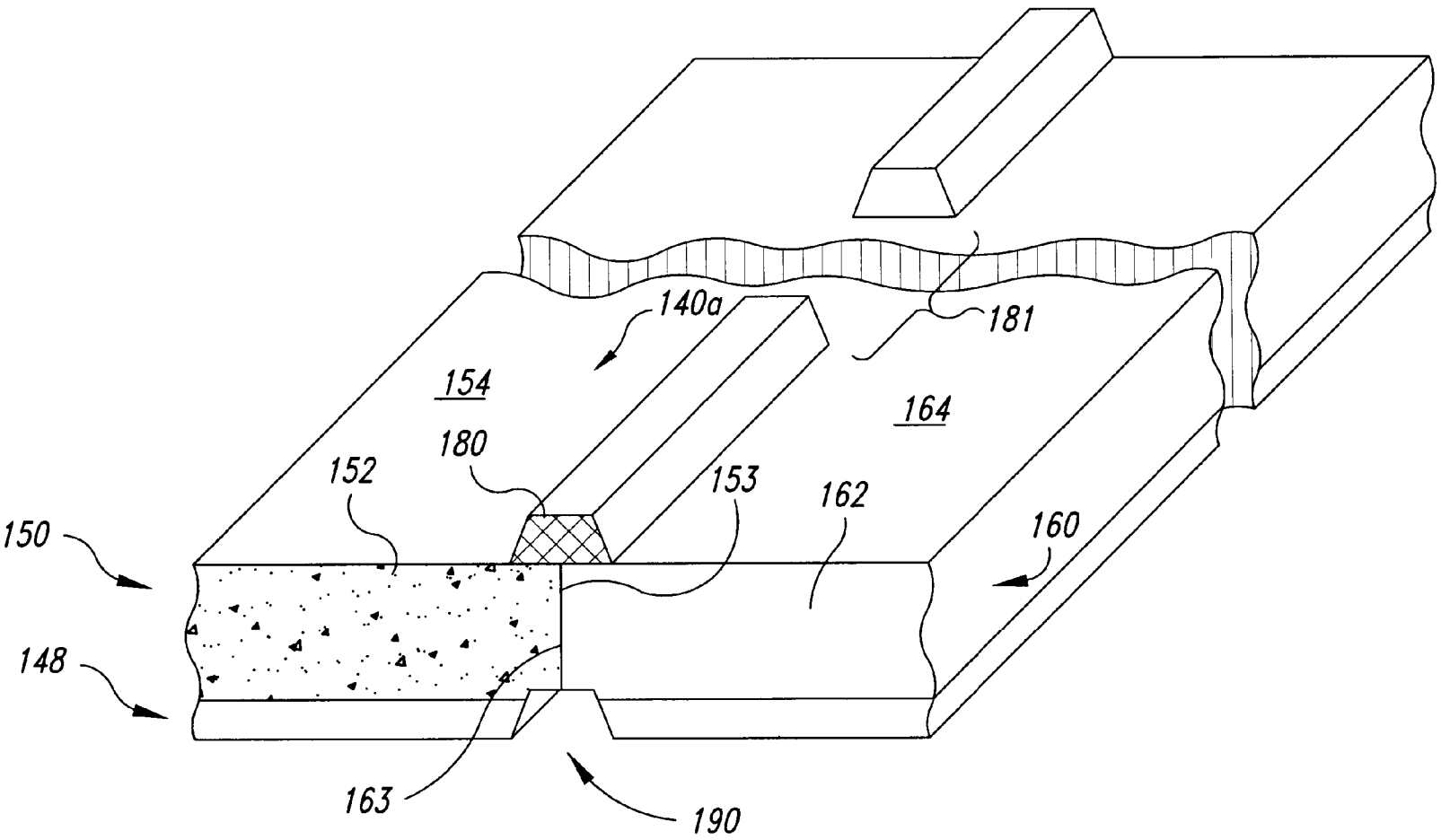
FIG. 5 is a schematic cross-sectional view of another processing medium in accordance with another embodiment of the invention.

FIG. 5 is a schematic cross-sectional view of another embodiment of a processing medium **140*a* in accordance with the invention. The processing mediums 140 and 140*a* may be similar to one another, and thus like reference numbers in FIGS. 2–5 refer to similar components. In addition to the features of the processing medium 140, the processing medium 140*a* has a ridge 180 extending longitudinally above the web and a corresponding channel 190 in the web under the ridge 180. The ridge 180 may have a trapezoidal cross-sectional shape, but other cross-sectional geometries may be used (e.g., rectangular or semi-circular). Additionally, a number of large gaps 181 may divide the ridge 180 into segments to allow the substrate 12 to slide from the planarizing section 150 to the finishing section 160 without disengaging the processing medium 140*a*. The channel 190 is configured to receive the ridge 180 so that the pre-operative and post-operative portions of the processing medium 140 may be tightly wrapped around the supply and take-up rollers 120, 123 (FIG. 2). As such, the planarizing and finishing surfaces 154 and 164 of an inner wrapping may abut the backing film 148 of an immediately adjacent outer wrapping. The ridge 180** may be made from rubber, plastic or a suitably flexible material that is impervious to planarizing chemicals.

The processing medium 140*a* allows the finishing cycle to be performed contemporaneously with the planarizing cycle because it separates the planarizing liquid from the cleaning fluid. The ridge 180, for example, partitions the processing medium 140*a* to prevent mixing between a planarizing liquid (not shown) on the planarizing medium 150 and a cleaning fluid (not shown) on the finishing medium. The ridge 180 accordingly allows incompatible planarizing liquids and cleaning fluids may be used contemporaneously on the processing medium 140*a*. As such, the planarizing liquid may be an ammonium or potassium slurry with abrasive particles and the cleaning fluid may be deionized water. As described in detail below with reference to FIGS. 6–7B, the utility of the processing medium 140*a* is better understood in the context of a planarizing machine having multiple carrier assemblies and substrate holders.

Figure 6:
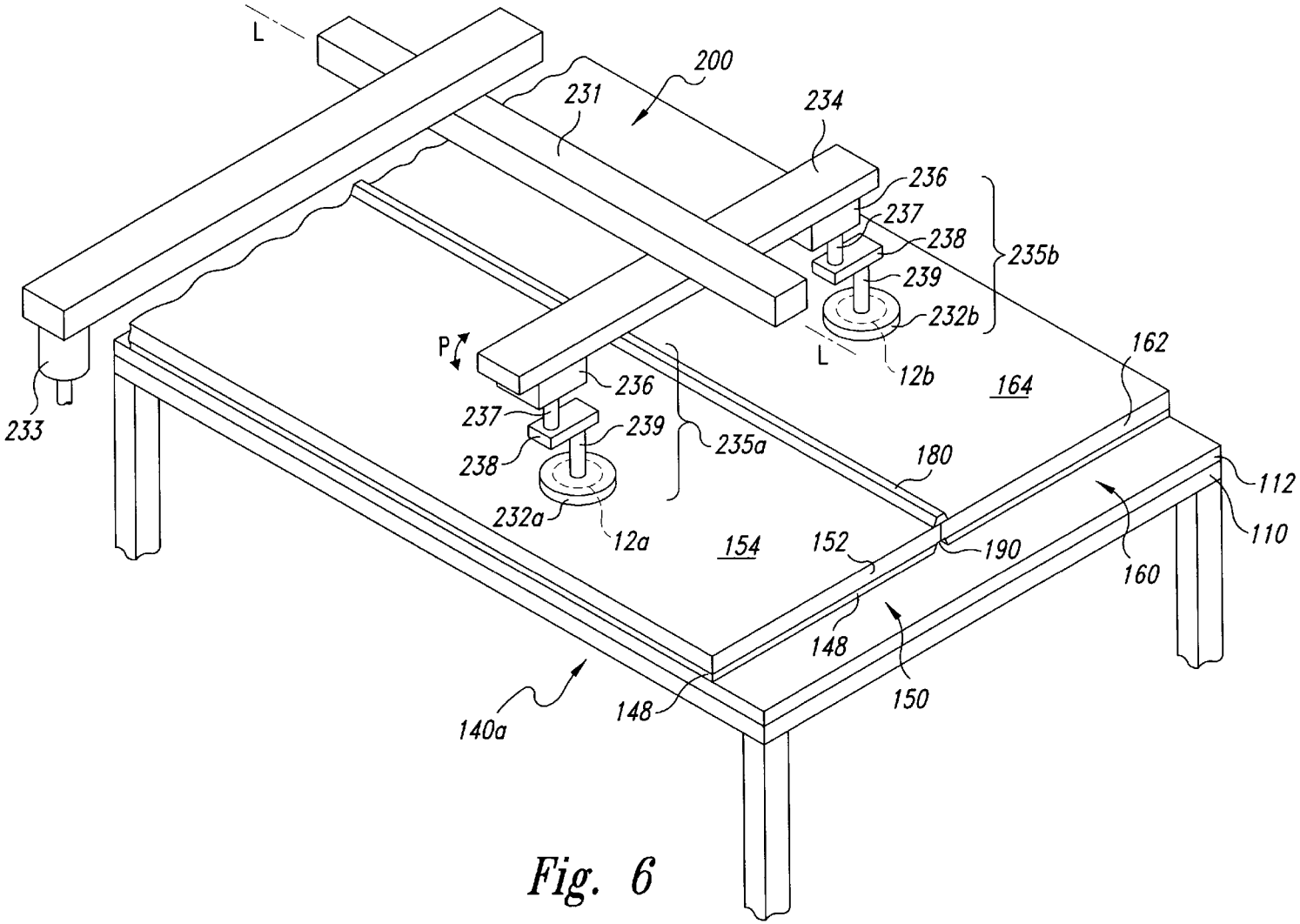
FIG. 6 is a partial isometric view of another planarizing machine having a plurality of carrier assemblies and substrate holders for use with a processing medium in accordance with an embodiment of the invention.

FIG. 6 is a partial isometric view of another embodiment of a planarizing machine 200 in accordance with the invention. The planarizing machine 200 is a dual-head machine with a carrier assembly 230 having a beam 231 attaching to a lifting mechanism 233 of the planarizing machine 200. A gantry 234 is movably attached to the beam 231 to translate along the longitudinal axis L—L of the beam 231 and pivot about a point along the beam 231 (arrow P). The planarizing machine 200 also has a first drive assembly 235*a* attached to one end of the gantry 234 and a second drive assembly 235*b* attached to the other end of the gantry 234. Each drive assembly 235*a*, 235*b* has an actuator 236 with a drive shaft 237, an arm 238 attached to the drive shaft 237, and another shaft 239 depending from the arm 238. The first drive assembly 235*a* carries a first substrate holder 232*a* and the second drive assembly 235*b* carries a second substrate holder 232*b*. The first and second drive assemblies 235*a*, 235*b* operate independently from one another so that a first substrate 12*a* may be planarized on the planarizing surface 154 of the planarizing section 150 while a second substrate 12*b* is finished on the finishing surface 164 of the finishing section 160.

Figure 7A:
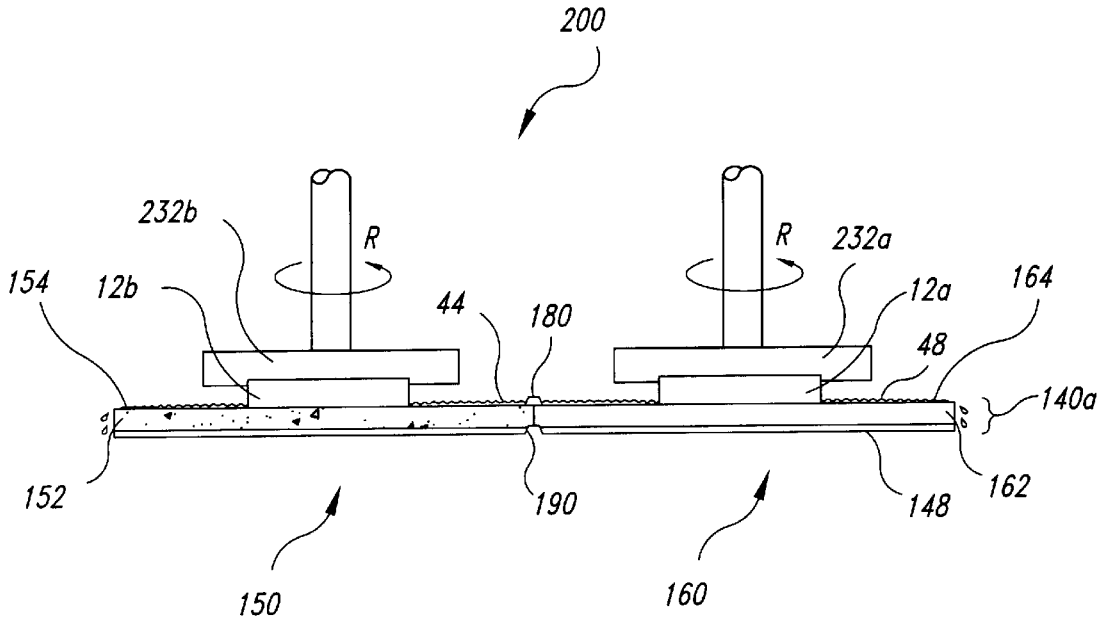
FIG. 7A is a partial schematic cross-sectional view of the planarizing machine of FIG. 6 illustrating one stage in the operation of the machine.

FIG. 7A is a partial schematic view illustrating a stage in the operation of the planarizing machine 200. At this stage of the process, the first substrate 12*a* has already been planarized on the planarizing section 150 and the second substrate 12*b* has already been loaded into the second substrate holder 232*b*. The gantry 234 (FIG. 6) has also been lifted and then pivoted to switch the position of the first and second substrate holders 232*a* 232*b* so that the first substrate holder 232*a* is over the finishing section 160 and the second substrate holder 232*b* is over the planarizing section 150. The first drive assembly 235*a* (FIG. 6) accordingly moves the first substrate 12*a* across the finishing surface 164 of the finishing section 160 in the presence of a cleaning fluid 48 to buff and clean the first substrate 12*a*. As the first substrate 12*a* is being cleaned on the finishing section 160, the second drive assembly 235*b* (FIG. 6) moves the second substrate 12*b* across the planarizing surface 154 of the planarizing section 150 in the presence of a planarizing liquid 44 to planarize the second substrate 12*b*.

Figure 7B:
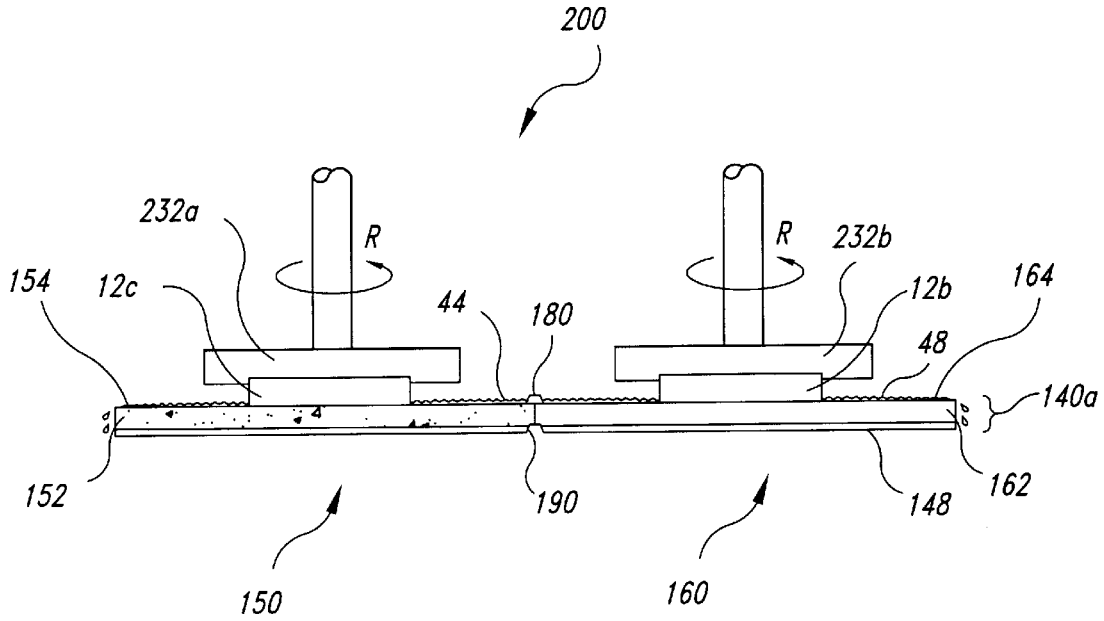
FIG. 7B is a partial schematic cross-sectional view of the planarizing machine of FIG. 6 illustrating another stage in the operation of the machine.

FIG. 7B is a partial schematic view illustrating a subsequent stage in the operation of the planarizing machine 200. At this stage, a third substrate 12*c* replaces the first substrate 12*a* in the first substrate holder 232*a*, and the gantry 234 (FIG. 6) has been pivoted about the beam 231 (FIG. 6) to position the third substrate 12*c* over the planarizing section 150 and the second substrate 12*b* over the finishing section 160. The third substrate 12*c* is then planarized while the second substrate 12*b* is buffed and cleaned. Thus, the planarizing machine 200 provides contemporaneous planarizing and finishing of two separate substrates with the same machine.

The embodiments of the planarizing machine 200 and the processing medium 140*a* shown in FIGS. 6–7B are expected to significantly increase the throughput of planarizing and finishing substrates. Unlike conventional planarizing machines with a single head that moves between separate planarizing and finishing pads, the planarizing machine 200 can finish one substrate while it planarizes another. The finishing cycle of one substrate on the planarizing machine 200, therefore, does not delay the planarizing cycle for a subsequent substrate. As such, the planarizing machine 200 and the processing media 140 or 140*a* should significantly increase the throughput of finished wafers compared to conventional planarizing machines.

Figure 8:
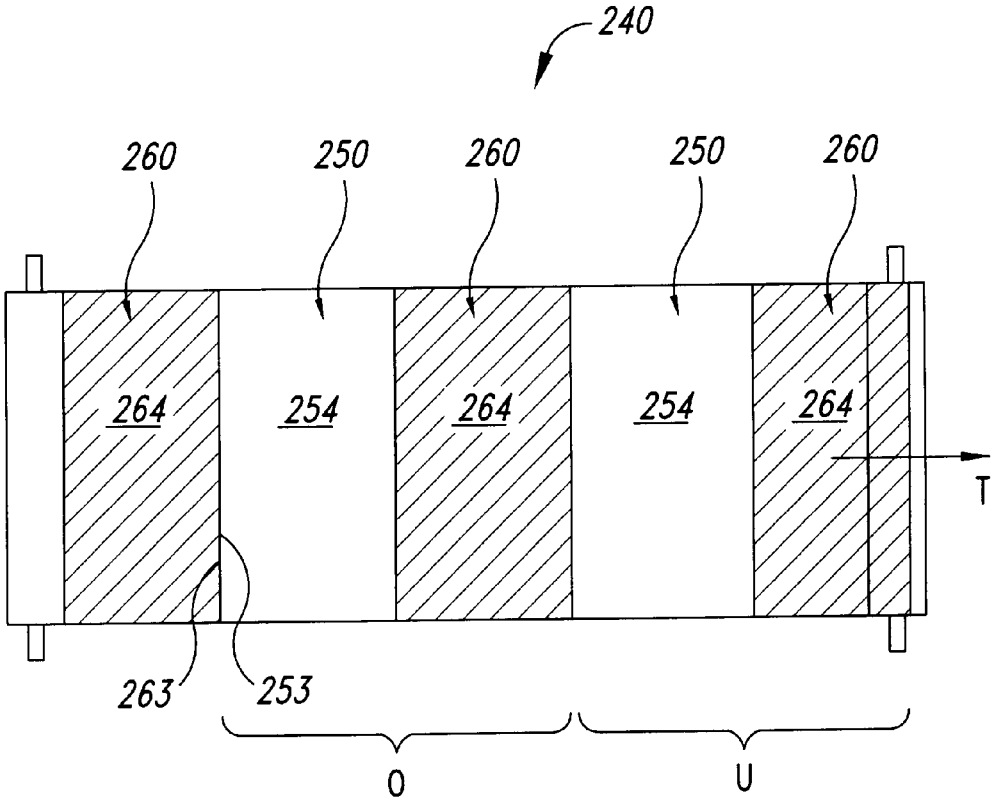
FIG. 8 is a partial schematic top view of a planarizing machine with a processing medium in accordance with another embodiment of the invention.

FIG. 8 is a partial schematic top view of another embodiment of a processing medium 240 in accordance with the invention. In this embodiment, a plurality of planarizing sections 250 and a plurality of finishing sections 260 are coupled to the backing film (not shown) in alternating sections extending transverse to the longitudinal axis of the web. Adjoining planarizing sections 250 and finishing sections 260 may also be coupled together along abutting edges 253, 263 extending transverse to the length of the web. The processing medium 240 may be incrementally advanced along a path of travel (arrow T) so that a pre-operative set of planarizing and finishing sections 250, 260 are positioned in an operating zone "O" and a used set of sections 250, 260 are positioned in a used zone "U." The processing medium 240 is similar to those described above with reference to FIGS. 2–7B, and thus the processing medium 240 may operate in a similar manner and achieve many of the same advantages.

Although specific embodiments of the invention have been described above for purposes of illustration, from the foregoing it will be appreciated that various modifications may be made without deviating from the spirit and scope of the invention. For example, the planarizing and finishing sections of the processing media may be composed of different materials in lieu of those specifically disclosed above. Additionally, processing media and planarizing machines in accordance with the present invention are not limited or required to achieve substantially the results as the embodiments of the processing media and planarizing machines described above. The invention, therefore, is not limited except as by the appended claims

What is claimed is:

1. A planarizing machine, comprising:

a table with a stationary support base;

a processing medium attached to the stationary support base, the processing medium having a planarizing section and finishing section proximate to the planarizing section, the planarizing section extending lengthwise along the processing medium and having a first body composed of a first material and a relatively firm planarizing surface, the first body supporting abrasive particles at the planarizing surface to remove material from a substrate during a planarizing cycle, and the finishing section extending lengthwise along the processing medium and having a second body composed of a second material and a buffing surface softer than the planarizing surface to clean the substrate during a finishing cycle, the planarizing and finishing sections being abutted against one another along a boundary extending longitudinally along the processing medium; and a carrier assembly having at least a first substrate holder positionable over the stationary processing medium, the first substrate holder translating the substrate over the planarizing section during the planarizing cycle, and the first substrate holder moving the substrate to the finishing section at the same work-station and translating the substrate over the finishing section in the presence of a cleaning fluid during the finishing cycle.

2. The planarizing machine of claim 1 wherein the first body is composed at least in part of a firm polymeric material.

3. The planarizing machine of claim 2 wherein the first body is composed at least in part of a porous polyurethane and a plurality of polyethylene stiffening beads embedded in polyurethane.

4. The planarizing machine of claim 2 wherein the first body is further composed of abrasive particles fixedly bonded to the polyurethane at the planarizing surface.

5. The planarizing machine of claim 1 wherein the finishing section comprises a napped material.

6. The planarizing machine of claim 1 wherein the finishing section comprises a napped polyurethane.

7. The planarizing machine of claim 1 wherein the backing film comprises a substantially incompressible copolymer.

8. The planarizing machine of claim 7 wherein the backing film is sheet selected from one of a polyester and a polycarbonate.

9. The planarizing machine of claim 1, further comprising a second substrate holder positionable over the processing medium, the second substrate holder being positionable over one of the finishing section or the planarizing section when the first substrate holder is positioned over the other of the finishing section or the planarizing section, the first and second substrate holders contemporaneously planarizing and finishing at least two separate substrates on the planarizing and finishing sections of the processing medium.

10. The planarizing machine of claim 1, further comprising:

a supply roller around which a pre-operative portion of the processing medium is wrapped: and a take-up roller around which a post-operative portion of the processing medium is wrapped, the processing medium being a web extending between the supply and take-up rollers so that an operative portion of the web is positioned on the support base, and the supply and take-up rollers being movable to incrementally advance the web across the support base.

11. The planarizing machine of claim 10, further comprising a second substrate holder positionable over the processing medium, the second substrate holder being positionable over one of the finishing section or the planarizing section when the first substrate holder is positioned over the other of the finishing section or the planarizing section, the first and second substrate holders simultaneously planarizing and finishing at least two separate substrates on the planarizing and finishing sections of the web.

12. A planarizing machine, comprising:

a table with a support base;

a supply roller;

a take-up roller;

a processing medium having a first portion wrapped around the supply roller, a second portion wrapped around the take-up roller, and an operative portion between the first and second portions positioned on the support base, the processing medium including a backing film, a first section coupled to one area of the backing film, and a second section coupled to another area of the backing adjacent to the first section, the first section having a planarizing surface to remove material from a substrate in the presence of a planarization liquid during a planarizing cycle, and the second section having a finishing surface to buff the substrate during a finishing cycle; and a carrier assembly having at least a first substrate holder and a second substrate holder the first substrate holder being selectively positionable over one of the first or second sections of the processing medium and the second substrate holder being positionable over the other of the first or second sections of the processing medium, the first substrate holder translating a first substrate over the one of the first and second sections of the processing medium and the second substrate holder contemporaneously translating a second substrate over the other of the first and second sections of the processing medium to contemporaneously planarize and finish the first and second substrates.

13. The planarizing machine of claim 12 wherein the backing film comprises a substantially incompressible copolymer.

14. The planarizing machine of claim 13 wherein the backing film is selected from one of a polyester and a polycarbonate.

15. The planarizing machine of claim 12 wherein the first section comprises a firm polymeric material.

16. The planarizing machine of claim 12 wherein the first section comprises a suspension material and a plurality of abrasive particles fixedly bonded to the suspension material at the planarizing surface.

17. The processing machine of claim 16 wherein the second section comprises a napped polyurethane, the second section being softer than the first section.

18. The planarizing machine of claim 12 wherein the processing medium further comprises a ridge above the first and second sections, the ridge partitioning the processing medium to prevent the planarizing liquid on the first section from mixing with a cleaning fluid on the second section.

19. The planarizing machine of claim 18 wherein the processing medium further comprises a channel extending along the bottom surface of the processing medium to receive the ridge for the portions of the processing medium wrapped around the rollers.

20. A planarizing machine, comprising:

a table with a support base;

a supply roller;

a take-up roller;

a processing medium having a pre-operative portion wrapped around the supply roller, a post-operative portion wrapped around the take-up roller, and an operative portion positioned on the support base, the processing medium being a web including a planarizing zone with a planarizing surface and a finishing zone with a buffing surface proximate to the planarizing zone, the planarizing surface being configured to remove material from a surface of one substrate in the presence of a planarizing liquid during a planarizing cycle, and the buffing surface being configured to clean another substrate during a contemporaneous finishing cycle; and a carrier assembly having a first substrate holder positionable over one of the planarizing zone or the finishing zone and a second substrate holder contemporaneously positionable over the other of the planarizing zone and the finishing zone, wherein at least one of the processing medium and the first and second holders move to translate first and second substrates with respect to the planarizing and finishing zones.

21. The planarizing machine of claim 20 wherein the planarizing zone is defined by a first body composed of, at least in part, a firm polymeric material.

22. The planarizing machine of claim 21 wherein the first body comprises a suspension material and a plurality of abrasive particles bonded to the suspension material at the planarizing surface.

23. The planarizing machine of claim 20 wherein the finishing zone is defined by a second body composed, at least in part, of a compressible material.

24. The planarizing machine of claim 23 wherein the second body comprises napped polyurethane.

25. The planarizing machine of claim 20, further comprising a backing film attached to the planarizing and finishing zones.

26. The planarizing machine of claim 20 wherein the processing medium further comprises a ridge extending above the planarizing zone and the finishing zone of the processing medium the ridge partitioning the processing medium to prevent the planarizing liquid from mixing with a cleaning fluid.

27. The planarizing machine of claim 1, further comprising a plurality of planarizing sections and finishing sections with a lengthwise dimension extending transverse to a longitudinal axis of the processing medium and arranged in a pattern in which the planarizing and finishing sections alternate with one another along the longitudinal axis of the processing medium.

* * * * *